US006640524B1

(12) United States Patent
Dunton et al.

(10) Patent No.: US 6,640,524 B1
(45) **Date of Patent: *Nov. 4, 2003**

(54) LATCH FOR ANIMAL RIGGING AND METHOD OF USE

(75) Inventors: Nicholas M. Dunton, Morro Bay, CA (US); Steven M. Dunton, Morro Bay, CA (US)

(73) Assignee: Ken Lerno, Atascadero, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/176,352

(22) Filed: Jun. 18, 2002

Related U.S. Application Data

(63) Continuation of application No. 09/642,548, filed on Aug. 17, 2000, now Pat. No. 6,427,426, which is a continuation of application No. 09/260,850, filed on Feb. 20, 1998, now Pat. No. 6,105,345.

(51) Int. Cl.[7] ..... B68B 1/00
(52) U.S. Cl. ..... 54/1
(58) Field of Search ..... 54/1, 69; 24/33 P, 24/429

(56) References Cited

U.S. PATENT DOCUMENTS

| | | | | | |
|---|---|---|---|---|---|
| 98,147 | A | | 12/1869 | Chestnut, Jr. | 54/69 |
| 1,748,880 | A | * | 2/1930 | Hill | 24/33 C |
| 2,145,118 | A | | 1/1939 | Knoess | 24/429 |
| 2,307,711 | A | | 1/1943 | Schaaff | 24/429 |
| 2,893,007 | A | * | 7/1959 | De Windt | 16/373 |
| 3,616,595 | A | | 11/1971 | Townsend | 54/1 |
| 3,733,530 | A | | 5/1973 | Labart et al. | 54/1 X |
| 4,267,685 | A | | 5/1981 | Cragin | 54/1 |
| 4,455,718 | A | | 6/1984 | Finnern | 24/33 P |
| 5,771,668 | A | | 6/1998 | Younger | 54/1 |

* cited by examiner

*Primary Examiner*—Robert P. Swiatek
(74) *Attorney, Agent, or Firm*—Leo F. Costello

(57) ABSTRACT

A latch inserted in an animal rigging and controllably releasable for quick unlatching. Such a rigging is normally cinched about the body of the animal for various purposes, but with the latch in the rigging, the rigging can be quickly released from the animal when desired. For a bull rigging, the latch is inserted in the rope that assists a rider in maintaining balance on the animal and allows the rider to be quickly separated from the animal if a limb of the rider becomes caught in the rope when the rider is thrown from the animal. The bull rigging includes a holder or handle interfittingly engaged by a limb of the rider while mounted on the animal to aid the rider in remaining balance on the animal. The inserted latch is normally closed but may be released, that is, unlatched, either by the rider if possible or by an attendant or otherwise if the limb of the rider is entangled with and caught in the rigging when the rider is thrown from the animal whereby the rider and the rigging can be pulled from or otherwise separated from the animal.

11 Claims, 6 Drawing Sheets

LATCH FOR ANIMAL RIGGING AND METHOD OF USE

CROSS REFERENCE TO RELATED APPLICATION

This application is a continuation of our prior application Ser. No. 09/642,548, filed Aug. 17, 2000, now U.S. Pat. No. 6,427,426, and entitled Method and Apparatus for Safely Riding An Animal, that in turn is a continuation of our application Ser. No. 09/026,850, filed Feb. 20, 1998, now U.S. Pat. No. 6,105,345, and entitled Safety Apparatus and Method for Riding an Animal.

FIELD OF THE INVENTION

The present invention pertains to a latch for an animal rigging and to a method for its use and more particularly to a releasable latch that is insertable in a rigging that is attached to an animal and that can be quickly and controllably unlatched.

BACKGROUND

Riggings are used on animals for various purposes including to provide a hand-hold for a bull rider, as discussed in more detail below, but animal riggings for other purposes are well known in the art.

Bull riding is considered the rodeo's roughest, wildest, and most dangerous event. It is easy to see why. Bull riders are usually of slight build, weighing from one hundred thirty to one hundred fifty pounds. In contrast, the roughstock selected for bull riding are usually specially cross-bred and managed Brahma bulls with known reputations and characteristics. These bulls have great strength and ferocity, are extremely quick despite their size, and have a predisposition to attack a human. Such a bull can weigh more than a ton, can lift more than its weight, has the agility to jump higher than its height, and can have sharp horns exceeding one foot in length. Unlike a horse that will look back and interact with its rider and avoid stepping on him if thrown, a bull has little empathy for its rider and will attempt to trample on and gore a down rider.

As is well known, while the bull is in the chute, a bull rope is wrapped around the girth of the bull and provides a hand-hold back of the bull's hump. The bull rider mounts the bull and grasps the hand-hold with one hand by which he holds the rope tightly around the bull. The other hand remains free and must not touch the bull or the rope during the ride, or else the rider will be disqualified. Prior to grasping the hand-hold, the rider puts his holding hand in a glove saturated with rosin. The gloved hand is placed in the hand-hold, and the free end of the bull rope is wrapped around the hand so that the rider can obtain a tight grasp on the rope.

From the moment the gate opens, the rider must remain on the bull for at least eight seconds or be disqualified. During the ride, the bull ferociously tries every movement to dismount and injure the rider—bucking, spinning, twisting, bolting forward and then abruptly stopping, flying completely off the ground and then slamming down hard, cocking his head and neck back and forth and from side to side thereby attempting to hook the rider with its horns, and rolling fore and aft and from side to side. Moreover, in contrast to a horse, the bull's skin is relatively loose on its body, causing the bull's hide to roll simultaneously with its other wild movements.

The rider must rely only on his single-handed grip of the bull rope, along with his training that provides him with a sense of timing, anticipation, and balance. Still, the odds greatly favor the bull in this contest in that statistics show that only about one out of ten or twelve riders remain on a bull for the required eight seconds. A rider may be considered lucky if he is thrown clear of the bull or if the attending cowboys, or so-called clowns, are able to distract the bull from a downed rider. Too often, the result of being thrown is serious injury or death.

In a desperate attempt to remain on the bull, the rider attempts to achieve a very tight grip on the rope before the chute is opened. Although a tight grip may be an advantage for staying mounted, it is a disadvantage if the rider is thrown from the beast. One of the most serious problems occurs when a rider is thrown from the bull but his hand remains caught in the bull rope. This can easily occur because before leaving the chute, riders typically pound their rosin-soaked glove hand around the rope, trying to tighten the grip. Also, because of the twists and turns of the bull, the rider's hand may become entangled in the hand-hold and the rope as he is thrown from the bull. Moreover, riders sometimes pack their hands too securely even to the extent of doing what is termed a "suicide wrap," that is, wrapping the bull rope around the gloved hand in such a way that it is almost inextricably connected to the bull rope under the riding conditions.

When a thrown rider's hand is caught, the clowns rush in and attempt to dislodge the hand. With the rigging currently used, the clowns must try to untie and unwind the rope from the caught hand or to slip the hand out of the rope and in this manner free the rider. For this purpose, a cowbell is often attached to the bull rope under the bull's belly to provide a large object that can be grabbed in an effort to control the rope.

These rescue efforts are by no means a satisfactory solution to the problem. It may be extremely difficult or impossible to dislodge the rider's hand while the bull continues to gyrate wildly. It also places the clowns, in addition to the rider, at risk. Every second is critical in this rescue mission. In severe situations, a dozen or more cowboys may encircle the bull attempting to control and to release the rider from the bull. In the meantime, the rider or one or more of the cowboys may be severely injured or killed.

SUMMARY

A latch is provided that may be inserted in an animal rigging and is controllably releasable for quick unlatching. Such a rigging is normally cinched about the body of the animal for various purposes, but with the latch in the rigging, the rigging can be quickly released from the animal when desired. For a bull rigging, the latch is inserted in the rope that assists a rider in maintaining balance on the animal and allows the rider to be quickly separated from the animal if a limb of the rider becomes caught in the rope when the rider is thrown from the animal. The bull rigging includes a holder or handle interfittingly engaged by a limb of the rider while mounted on the animal to aid the rider in remaining balance on the animal. The inserted latch is normally closed but may be released, that is, unlatched, either by the rider if possible or by an attendant or otherwise if the limb of the rider is entangled with and caught in the rigging when the rider is thrown from the animal whereby the rider and the rigging can be pulled from or otherwise separated from the animal.

An object of this invention is to provide a releasable latch for an animal rigging.

Another object is enable a rider to become separated, released, and/or pulled away from an animal if thrown therefrom while a limb of the rider remains caught in the rigging on the animal.

Another object is to enable a rider to maintain balance on an animal being ridden and yet to allow the rider to escape from the animal if thrown therefrom while a limb of the rider remains hung up in the rigging around the animal.

A further object is to enable a bull, or other rough animal, or any animal to be ridden in a safer manner.

An additional object is to reduce or prevent severe accidents or perhaps the deaths of bull riders as a result of being thrown from the bull while the rider's hand remains caught in the bull rope.

Yet another object is to allow bull riders to obtain tighter grips on the bull rope thereby to improve the rider's chances of remaining on the bull during a regulation ride while reducing the fear of being hung up in the bull rope if the rider is thrown from the bull while the rider's hand remains caught in the rope.

Another object is to provide a latch that dependably maintains the integrity of a bull rope for cinching around the bull during a bull riding session and yet can be quickly released to establish a break or separation in the rope if the rider is thrown from the animal and cannot release his hand from its grip on the rope.

An additional object is to enable a bull rider or an attendant such as a clown or other cowboy to release the bull rope from its cinched condition around the bull if the rider is thrown from the bull while his hand remains caught in the bull rope.

A still further object is to provide a safety latch for a bull rope having visible space thereon for indicia such as the rider's name, awards or insignia, a manufacturer's name, or other advertising material.

Yet another object is to provide a safety latch for a bull rope that is easy to incorporate in a standard bull rope.

Another object is to provide a safety latch which does not interfere with the operation of a standard bull rope.

An additional object is to provide a safety latch for the rigging on an animal being ridden that does not injure the animal.

These and other objects will become apparent upon reference to the following drawings and accompanying description.

DETAILED DESCRIPTION

Figure 1:
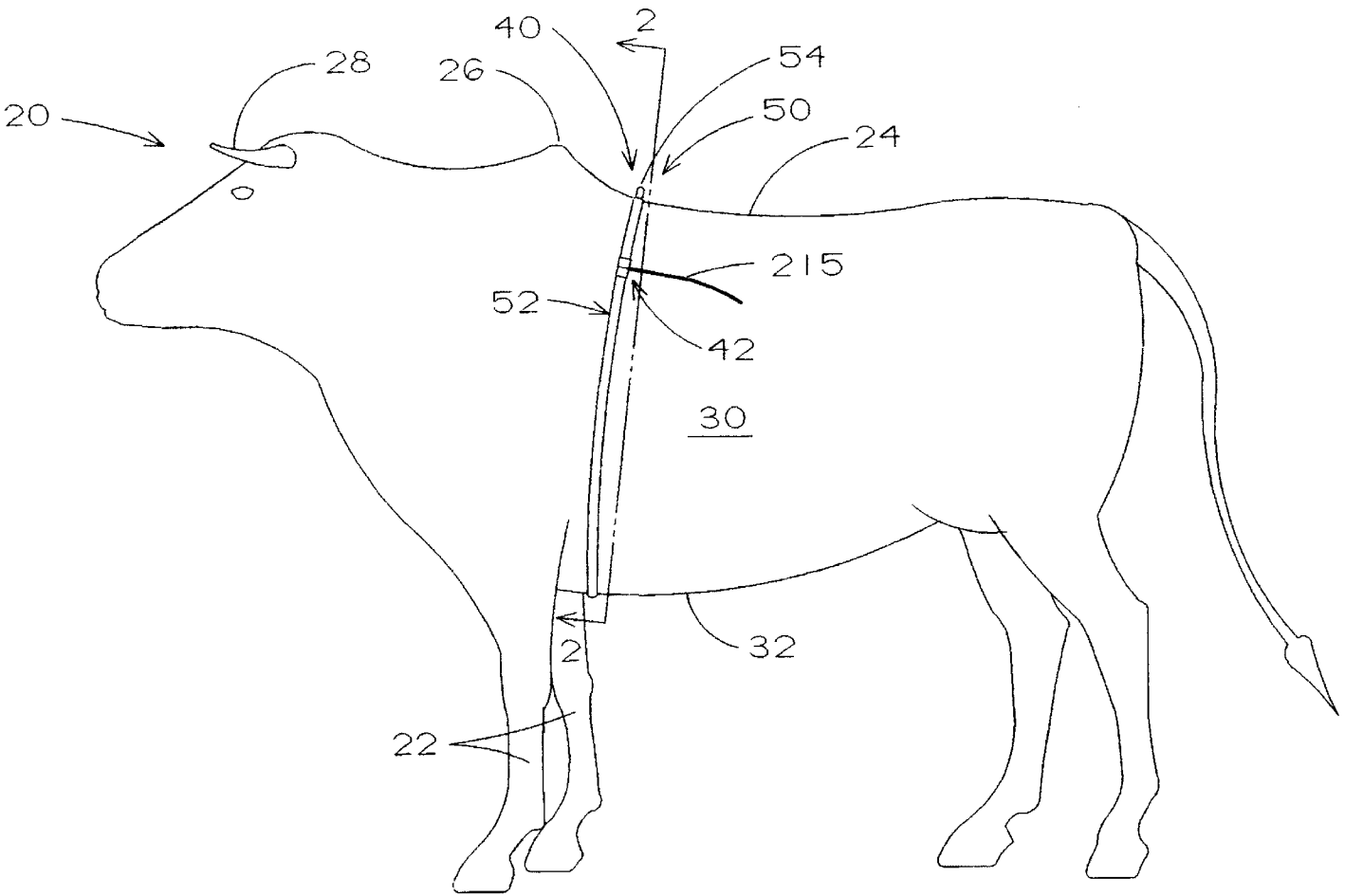
FIG. 1 is a side elevation of a Brahma bull with the bull rope cinched around the body of the bull and including the safety apparatus of the present invention.
Figure 2:
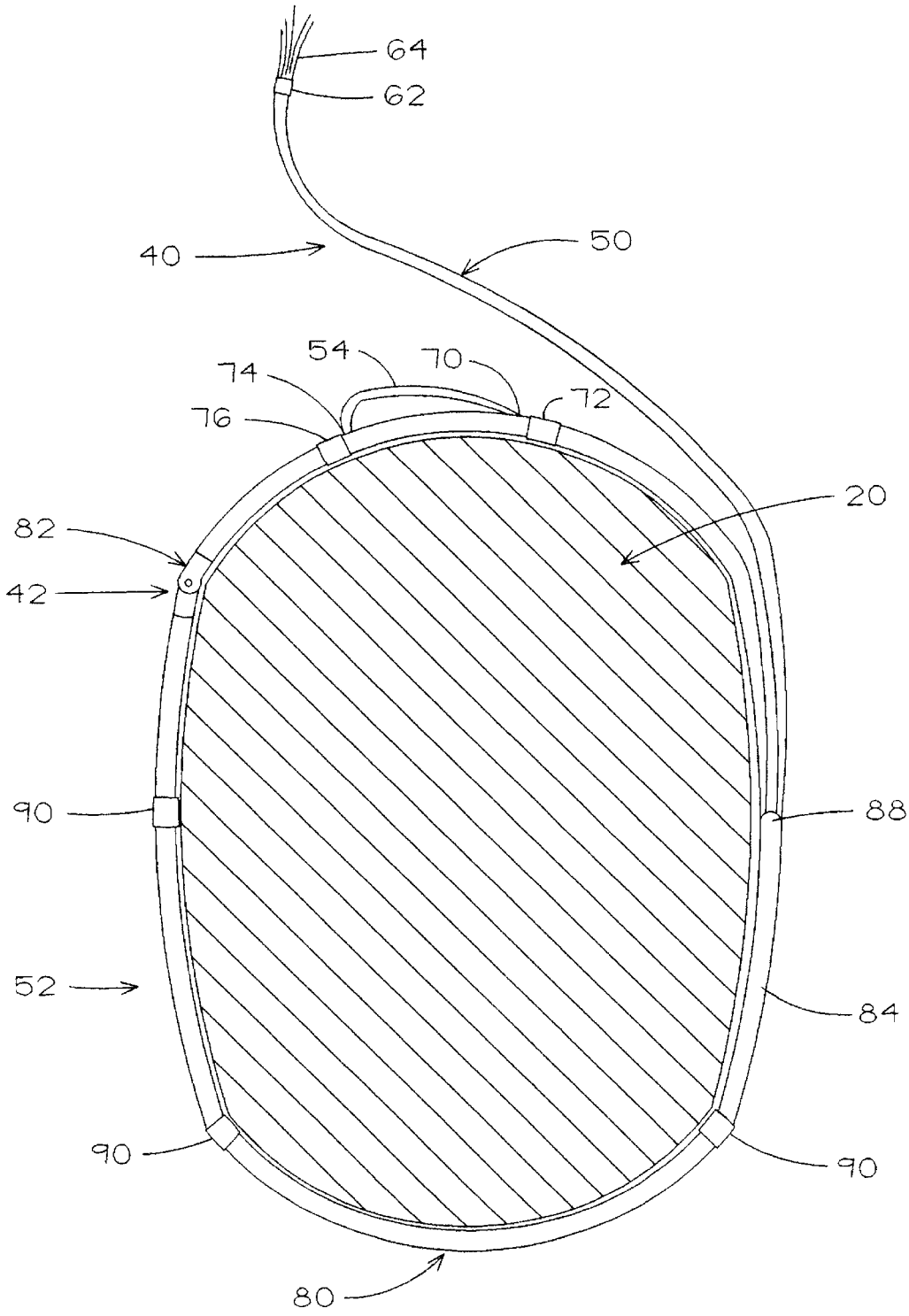
FIG. 2 is an enlarged transverse vertical section taken generally along line 2—2 in FIG. 1.

A Brahma bull 20 of the type used in rodeo competition for bull riding is generally shown in side elevation in FIG. 1. These are specially bred and managed animals, usually weighing more than a ton and standing about five feet in height. For purposes of subsequent reference, the bull has front legs 22, a back 24, a front hump 26, horns 28, a girth 30, and a belly 32. A bull rope or rigging 40 incorporating a latch 42 in accordance with the present invention is generally indicated in FIGS. 1 and 2. Except for the latch of the present invention, the bull rope is of well-known construction, the particular bull rope shown and described herein being manufactured by the Barstow Pro-Rodeo Equipment Company of 701 South Main Street, Suite 114, Corsica, Tex. 75110. The subject latch is not limited to use with this particular bull rope, however, as will be evident from the following description. Moreover, the present invention is not limited to use with a bull rope nor to bull riding but may be incorporated in other types of animal rigging where problems similar to those described herein are also encountered.

Before describing the latch 42 (FIGS. 1 and 2) of the present invention, the bull rope 40 shown in the drawings is described in some detail so that the manner of incorporating the latch may be better understood. Thus, the bull rope has a first-end portion 50 that is approximately eighty-seven inches long in the embodiment sold by the Barstow Company, a second-end portion 52 that is about seventy-seven inches long in the particular Barstow rope, and a handle or hand hold 54 that is about ten and a half inches long in the Barstow rope and that interconnects the first- and second-end portions of the rope. It is also to be noted that the invention is not limited to these or any other particular dimensions, such dimensions being given by way of providing a more complete description of the apparatus.

The first-end portion 50 (FIGS. 2 and 3) of the bull rope 40 is unchanged from the standard Barstow rope and is thus a single layer 61 of braided strands 63 of polyurethane or "poly" fibers 64, each strand being about one-eighth inch in diameter, and the layer being about seven-eighths inch wide by one-quarter inch thick, thus having a generally uniform rectangular cross-section. The first-end portion terminates in a free end 60 that is finished in a terminal wrapping 62 of a small diameter cord, thereby exposing a tassel of the poly fibers.

Figure 6:
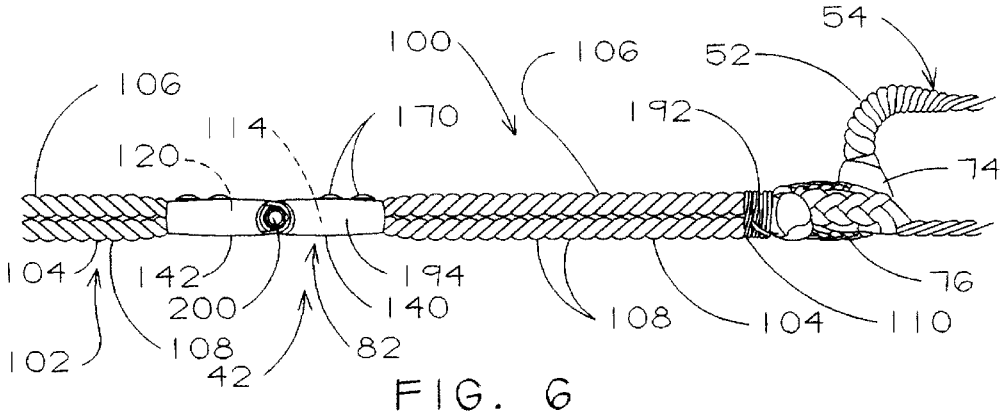
FIG. 6 is an fragmentary edge view of the bull rope and the safety apparatus as shown in FIG. 3 but showing less of the rope and omitting any showing of the animal.

The handle 54 (FIGS. 2, 3, and 6) is unmodified from the standard Barstow bull rope 40 and thus is a single layer of braided strands in which is embedded a steel wire, not shown, and which includes a leather strap intertwined with the strands and encircling the steel wire throughout its length. In the Barstow rope, this handle is about three-quarters of an inch wide and about one-half inch thick at its maximum dimension along the path of the embedded wire. The handle has a first end 70 joined to the first-end portion 50 of the rope, and a first wrapping 72 of leather straps encircles this juncture. The handle has a second end 74 that is raised relative to the first end, thereby to provide a convenient opening for the rider's hand and which is maintained by the shape of the embedded wire. This second end of the handle is joined to the second-end portion 52 of the rope, and a second leather wrapping 76 is intertwined with the strands of the rope to strengthen this juncture. The first wrapping is approximately one and five-eighths inch wide by three-quarters inch thick, and the second wrapping is about two inches wide and one and a quarter inch thick in the standard Barstow rope being described.

The second-end portion 52 of the bull rope 40 (FIGS. 2 and 3) is modified to incorporate the subject latch 42 and thus includes a looped section 80 and a latching section 82, the latter including the latch of the present invention. The looped section is a twisted pair 84 of polyurethane strands 86, each strand being about five-sixteenths of a inch in diameter. This pair of strands extends from the latching section to a doubled-back end 88 thereby providing a loop. A plurality of braided retaining rings 90 of corded material are slideably fitted over the stands 84 thereby to maintain the twisted pairs in adjacent spaced relation and to define a loop of restricted size at the end 88.

The latching section 82 (FIGS. 3, 4, and 6) includes separable upper and lower latching end portions 100 and 102 respectively joined to the handle 54 and the looped section 80. The upper and lower latching-end portions are of similar construction, each including inner and outer layers 104 and 106, each layer being composed of braided strands 108 of polyurethane fibers. The upper latching-end portion has an upper end 110 joined to the second end 74 of the handle 54 and a lower latching end 114. The lower latching-end portion 102 has a lower end 118 joined to the upper end of the looped section 80 and an upper latching end 120. The double layers 104 and 106 of each latching-end portion have a width of approximately one and one-quarter inch and a thickness of approximately three-quarters of an inch.

Figure 7:
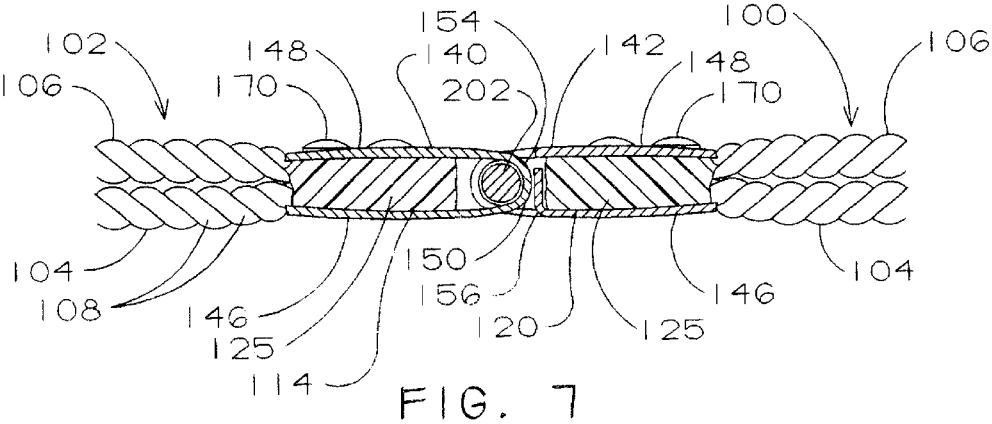
FIG. 7 is an enlarged fragmentary section taken along line 7—7 in FIG. 4.
Figure 9:
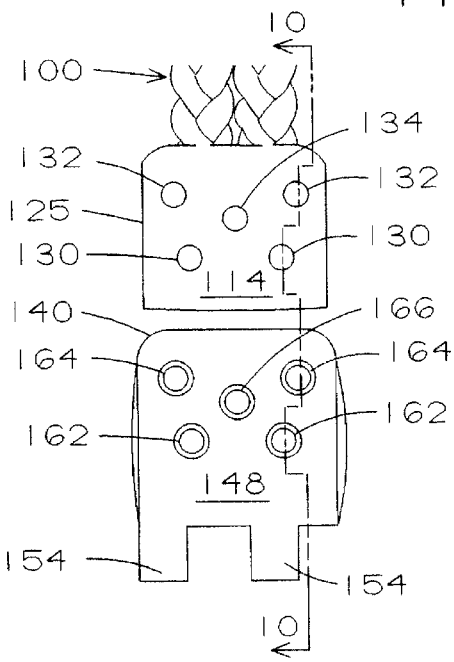
FIG. 9 is an exploded face view of one of the latching members of the present invention and its associated latching end portion of the bull rope.
Figure 10:
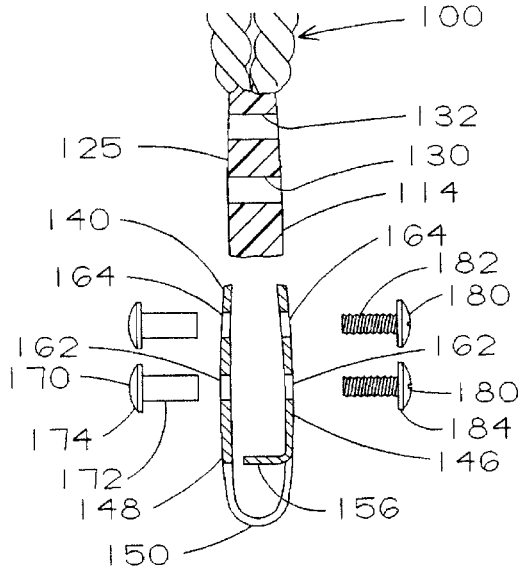
FIG. 10 is a section taken on line 10—10 in FIG. 9.

As best shown in FIGS. 7, 9, and 10, the latching ends 114 and 120 of the latching-end portions 100 and 102 are blocks 125 of plastic caused by heating the polyurethane fibers, whereby they soften and flow together, forming blocks upon cooling and hardening. A pair of front holes 130, a pair of rear holes 132, and a center hole 134 are drilled all the way through the blocks in a particular pattern as shown in FIG. 9 and for a purpose to be described.

Figure 8:
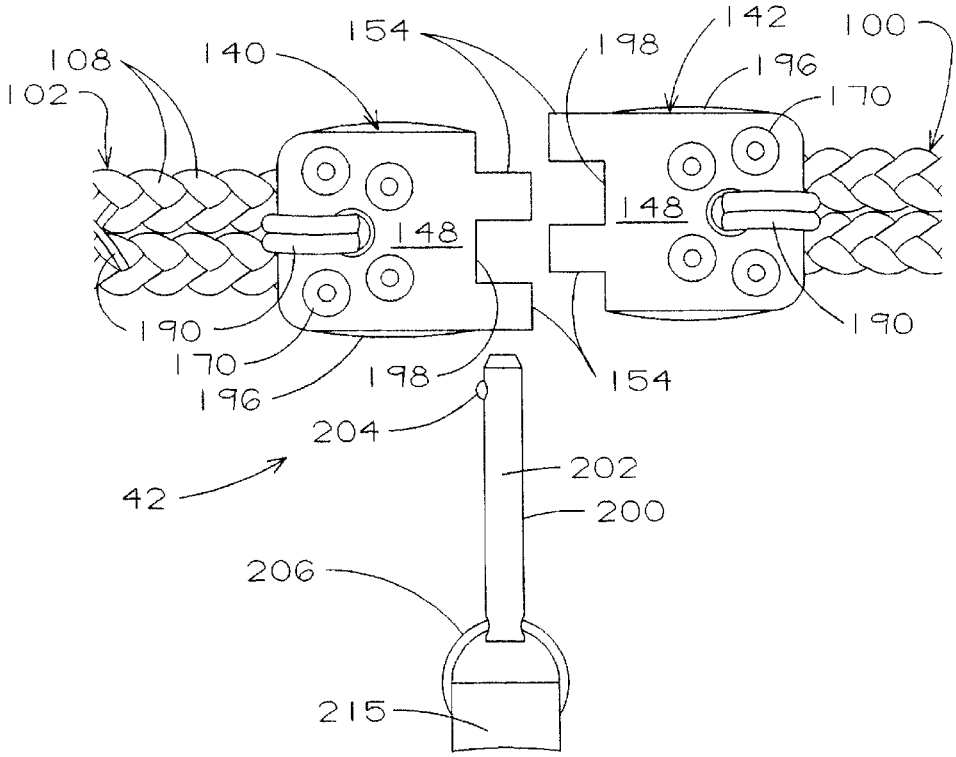
FIG. 8 is a fragmentary plan view of the subject safety apparatus on the same scale as FIG. 4 but showing the latch in unlatched position and oriented ninety degrees from FIG. 4.

The latch 42 (FIGS. 3 through 10) also includes upper and lower, U-shaped latching members 140 and 142 of a high-strength material such as steel or a high-strength plastic. In the preferred embodiment of the invention illustrated, these latching members are made of steel and are approximately one and five-eighths inch wide by two inches long by one-half inch thick, although it is reiterated that the invention is not limited to any particular dimensions. Each latching member includes generally rectangular inner and outer plate 146 and 148 (FIGS. 9 and 10, especially), connected by an arcuate bight 150. Each bight is formed with a pair of aligned-spaced eyelets 154 (FIGS. 8 through 10), and a stop tab 156 (FIGS. 7 and 10) projects inwardly from the inner plate toward the outer plate between the eyelets. The inner and outer plates of each latching member has two pair of aligned front holes 162 (FIGS. 9 and 10), two pair of aligned rear holes 164, and a pair of aligned center holes 166. The pattern of these holes is the same as the holes 130, 132, and 134 in the ends 114 and 120.

The lower and upper latching ends 114 and 120 (FIGS. 8 through 10) of the upper and lower latching-end portions 100 and 102 are respectively fitted in the upper and lower latching members 140 and 142 so that the respective front, rear, and center holes 162, 164, 166 in the latching members are in alignment with the front, rear, and center holes 130, 132, and 134 of the latching ends 114 and 120. As such, the ends 114 and 120 abut the stop tabs 156 of their respective latching members and do not encroach into the eyelets 154.

Four outside female fasteners 170 (FIGS. 7 through 10) include internally threaded sleeves 172 slideably fitted in the four pairs of aligned holes 130 through 162 and 132 through 164 and smooth heads 174 that are preferably received in countersunk recesses around the holes in the outer plates 148. Four inside bolts 180 have threaded shanks 182 fitted in the holes and threaded into respective sleeves of the fasteners. The bolts also have slotted heads 184 preferably received in countersunk areas around the holes of the inner plates 146. Thus, by tightening the four bolts, the upper and lower latching ends 120 and 114 are tightly sandwiched between the inner and outer plates 146 and 148 of the latching members 140 and 142.

To further secure each latching member 140 and 142 to its respective latching-end portion 102 and 100, a thong 190 (FIGS. 3, 4, and 8), preferably of leather, is threaded through the pair of aligned center holes 134 through 166 in each latching member. Each thong is interwoven with the strands 108 of its latching-end portion and then wrapped at 192 and 194 around the upper and lower ends 110 and 118 (FIG. 3) and tied. As such, each latching member is dependably connected to its respective latching-end portion. Each latching member 140 and 142 is also provided with side walls 196 and an end wall 198 (FIG. 8), thereby to enclose the latching ends 114 and 120 within the latching members. These side and end walls are provided by applying a cold bonding material in paste form, such as Loctite Weld, stock number 19986, which hardens upon drying.

The latch 42 further includes a latch pin 200 (FIGS. 3 through 8) having an elongated shank 202 which in the disclosed embodiment is approximately two inches long and about one-quarter inch in diameter. The latch pin is made of a high-strength material such as steel or a high-strength plastic, steel being used in the disclosed embodiment. The shank has front and rear ends, and a spring-pressed detent 204 is fitted in the front end of the shank so that it is spring-urged outwardly slightly from the outer diameter of the shank. Furthermore, a ring 206 similar to a key ring is connected to a hole in the rear end of the shank.

With the eyelets 154 of the latching members 140 and 142 interfitted so that all four eyelets are aligned (FIGS. 3 through 7), the shank is slideably inserted into the eyelets until the detent is exposed at the front of the latch. The latch pin can be slid between this latching position that holds together the latching members and thus the upper and lower latching-end portions 100 and 102 of the latching section 82, and a released position (FIG. 8) that allows these upper and lower latching end portions to be separated. The detent retracts to allow such movement between latching and unlatched positions of the latching pin but prevents the latch pin from simply falling out of its latched position.

A flexible pull strap 215 (FIGS. 1 and 3 through 5) of a suitable fabric or plastic material has a front end 218 that is looped around the ring 206 and a rear end 220 that extends freely from the ring. The pull strap has two functions; namely, to be grasped in order to pull the latch pin 200 from its latched position out of the latching members 140 and 142, and secondly, to provide a place for selected indicia, as indicated by the number 222 in FIG. 5. This indicia may include the name of the bull rider, awards or records of the rider, advertising material, or the like.

Upper and lower cover sleeves 230 (FIGS. 3 through 5) of a soft material, such as leather, are slideably fitted on the upper and lower latching-end portions 100 and 102. These sleeves have dimensions sufficient to allow them to be slid over the latching members 140 and 142 so as to conceal these latching members and prevent their direct contact with the bull 20 or other animal on which the rope 40 is used. As further such protection, an inside cover flap 232, also preferably of a soft material such as leather, has a neck 234 slideably received on the upper latching-end portion 100 above the upper cover sleeve 230 and a generally rectangular panel 236 that extends downwardly under both the latching members 140 and 142 so as to bridge the gap between these latching members and further to protect the latch from contacting the bull 40.

OPERATION OF THE APPARATUS AND DESCRIPTION OF THE METHOD

The apparatus of the present invention is particularly suited for use in a bull rope as 40 that is used for riding bulls, as 20, in a rodeo. Thus, initially and normally, the latch pin 200 is in its latching position (FIGS. 3 and 4) holding the separable ends 114 and 120 together so that the bull rope is intact in the usual way. That is, the latching members 140 and 142 are interfitted with the eyelets 154 aligned, and the latch pin is slideably fitted into the eyelets so as to releasably connect the latching members and thus the looped and latching sections 80 and 82 of the second-end portion 52 of the bull rope. In this condition, the bull rope is a continuous piece as a standard bull rope would be without the subject latch. The sleeves 230 and flap 232 are then slid into positions over the latching members and with the flap 232 bridging the two latching members. After the bull 20 is guided into the chute, the bull rope 40 is extended in a continuous and uninterrupted loop around the girth 30 of the bull (FIGS. 1 and 2) in the usual way so that the handle 54 is located behind the hump 36 on the back 24 of the bull and the latch 42 is disposed along one side of the bull (the bull's left side as illustrated, but it could be on the right side if desired).

As is normally done, the free end 60 (FIGS 1 through 3) of the first-end portion 50 of the bull rope 40 is extended through the looped end 88 of the second-end portion 52 of the rope and is pulled upwardly so as to cinch the rope around the bull. In this sense, the free end 60 and the looped end 88 may be referred to as cinching ends of the rope. With the bull rope thus around the bull, it is to be noted that the pull strap 215 extends freely rearwardly from the latch 42 and that the indicia 222 faces outwardly of the bull. It is also to be noted that the covers 230 and the flap 232 prevent direct contact between the latch and the bull and also conceal the latch.

Figure 3:
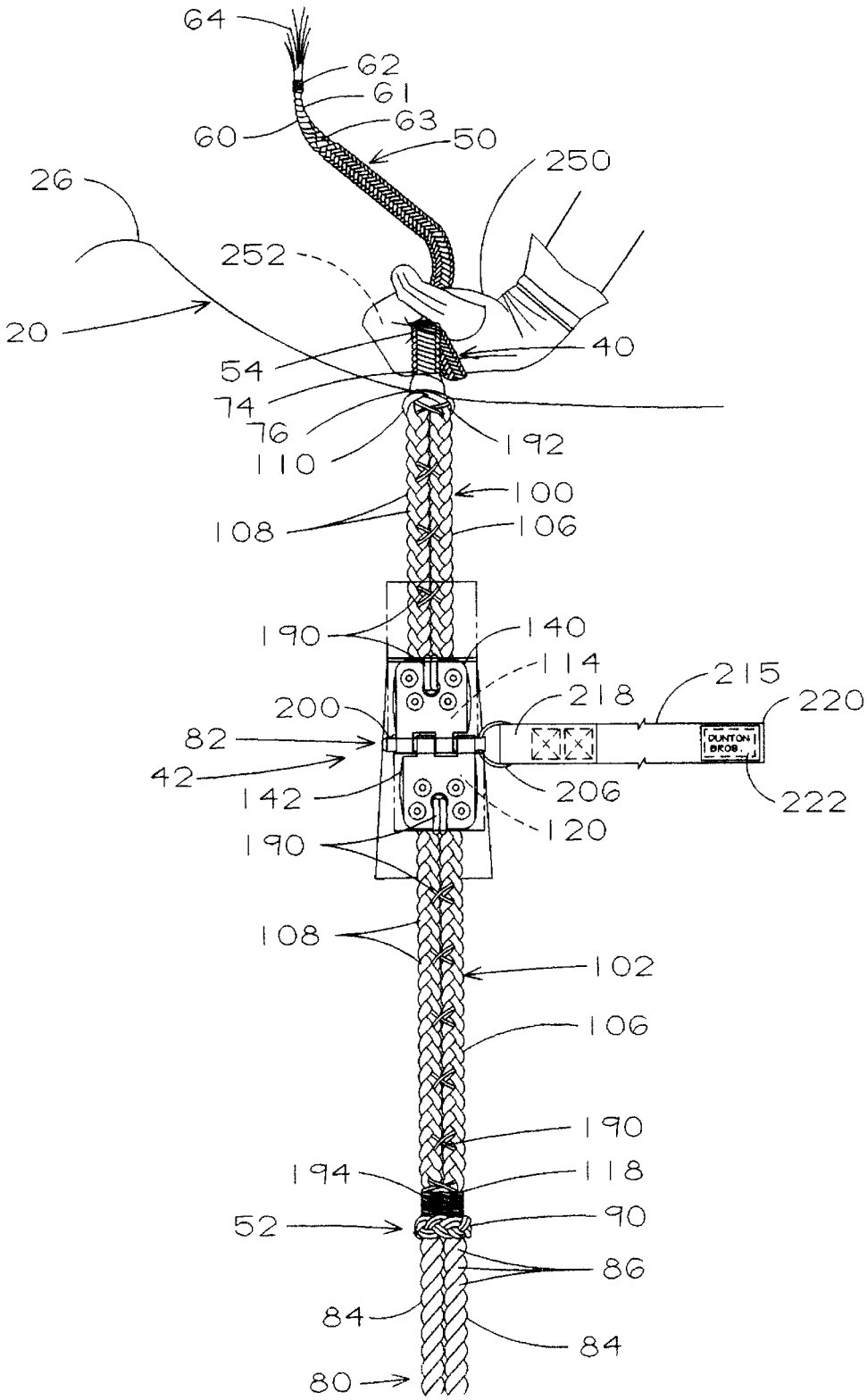
FIG. 3 is an enlarged face view of the safety apparatus as seen from the left side of FIG. 2 with bull rope being grasped by the gloved hand of a rider, but with the remainder of the bull rope, the bull's back, and the arm of a rider only partially shown.
Figure 4:
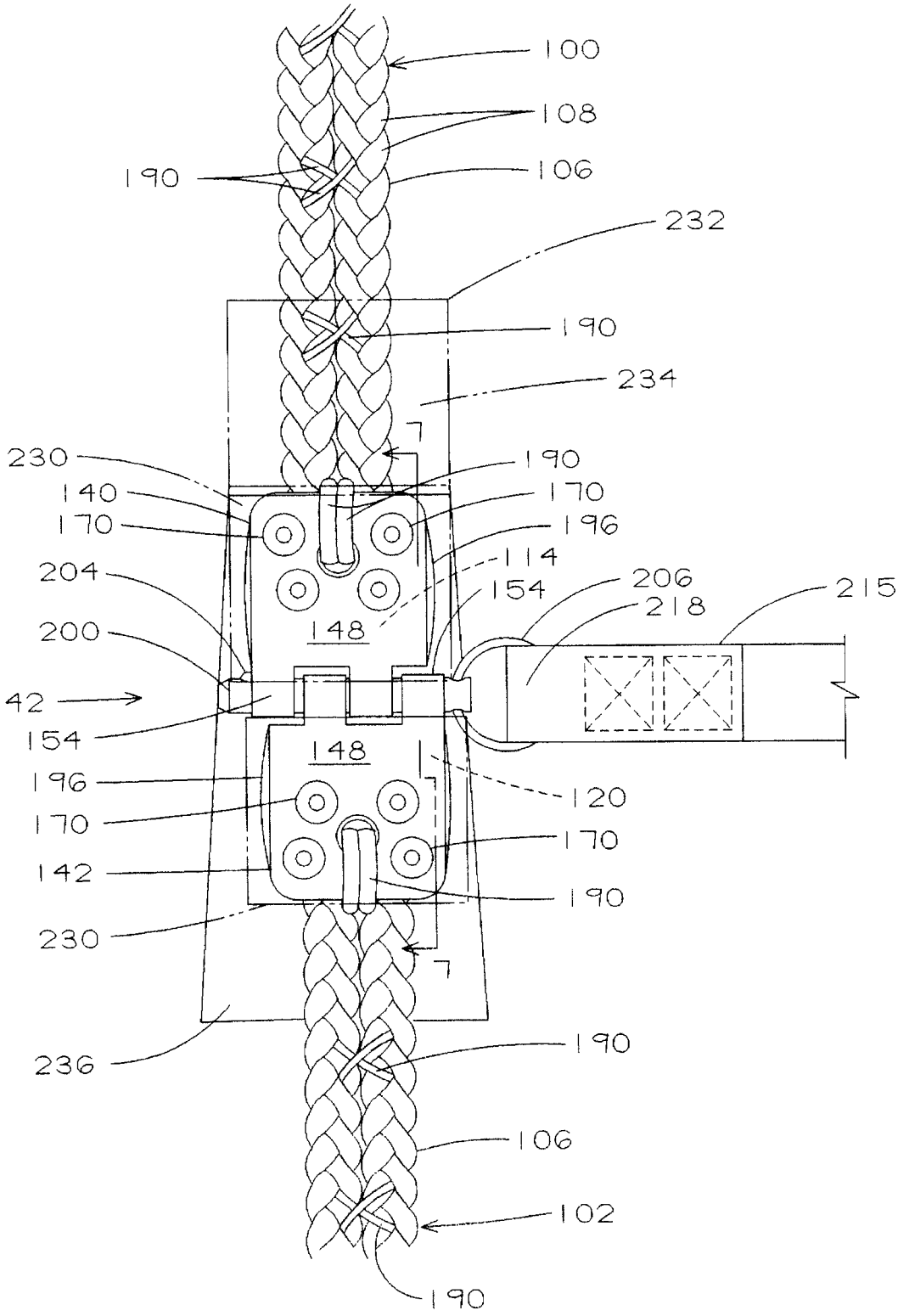
FIG. 4 is a still further enlarged fragmentary face view of the safety apparatus shown in its latched position with parts of covers shown in phantom to reveal latching members underneath.
Figure 5:
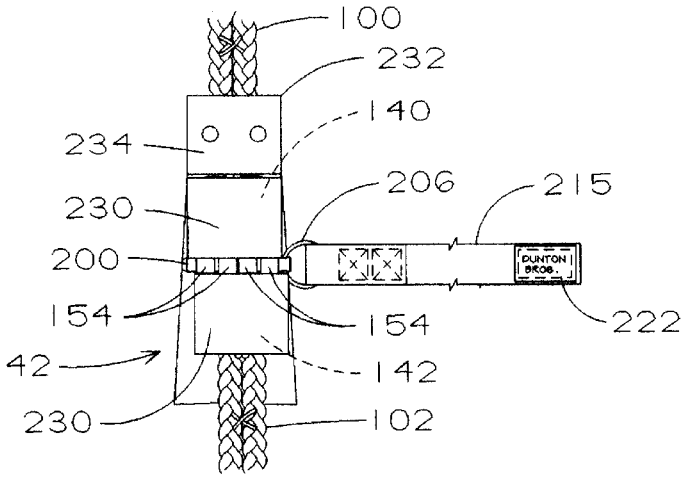
FIG. 5 is a fragmentary face view of the safety apparatus, at the same sale as FIG. 3, in its covered, latched position and also showing a pull strap extending rearwardly from the latch pin of the apparatus.

The rider, not shown, then mounts the bull 20 in the usual manner. The rider places a glove 250 (FIG. 3) on his hand 252 that he will use to grip the bull rope 40. As is well known, prior to wearing the glove, the glove is saturated in rosin to serve as a stiffener for the glove. When mounted on the bull, the rider grasps the free end 60 of the bull rope to pull it tight and also grasps the handle 54, as shown in FIG. 3. In order to maximize his grip, the rider will typically pound the finger of his gloved hand down tightly around the handle. The stiffened and pounded rosin-saturated glove tends to hold this pounded grip in place.

Cinching the bull rope 40 around the bull 20 in the usual manner as briefly discussed above is not affected in any way by the latch 42 since the latch pin 200 is in its latched condition thereby maintaining the continuity of the bull rope. However, cinching of the bull rope helps to tighten the latching members 140 and 142 against the latch pin which aids in maintaining the latch in latched condition. It is also to be noted that the indicia 222 on the outside of the pull strap 215 is clearly visible.

The chute, not shown, is then opened to allow the bull 20 to charge into the bull ring or arena whereupon the bull attempts to dislodge the rider, and the rider attempts to remain on the bull at least for the eight seconds required for a qualifying ride. During this time, the bull is bucking, spinning, twisting, bolting forwardly and then stopping abruptly, completely flying off the ground and slamming down hard, cocking his head and neck back and forth and from side to side thereby attempting to hook the rider with its horns, and also rolling fore and aft and from side to side, using every technique it can to throw the rider. The rider's only hold on the bull is by his gloved hand 252 holding the free end 60 and the handle 54 of the bull rope 40. He is not allowed to touch the rope or the animal with his free hand or else he will be disqualified.

Because of the importance of the rider's grip on the bull rope 40, a rider may wrap the free end of the rope too tightly around his hand 252. Accordingly, if the rider is thrown from the bull, this free hand may remain caught in the bull rope so that the rider is not thrown clear of the bull.

If the rider is thrown from the bull 20 while his hand remains hung up on the bull rope 40, the latch 42 of the present invention is used to rescue the rider. In this case, the latch pin 200 may be removed in one of two ways. If the rider is thrown from the bull 40 toward the side where the latch is located, the rider may be able to grasp the pull strap 215 and pull the latch pin 200 out of the latching members 140 and 142. Alternatively, cowboys or so-called clowns rush toward the bull when the rider is thrown. One of the clowns will attempt to dislodge the rider's hand, but the other one will grasp the pull strap 215 and pull the latch pin out of the latching members.

In either event, the latch pin 200 is pulled so as to unlatch the latch 42 and separate the latching-end portions 100 and 102 of the latching section 82 of the second-end portion 52 of the bull rope 40. Thus, the continuity of the bull rope when it is cinched about the bull 20 is broken. As such, it is then possible to separate the rider and the bull rope from the bull. Either the rider can himself pull away from the animal, or else the rider and the bull rope can be pulled away from the animal by the clowns.

The foregoing action is completed in a matter of seconds since every second counts in this very dangerous scenario. By nature, a bull has a predisposition to attack the rider. If the rider is down on the ground next to the bull, the bull will attempt to gore him or step on him, or otherwise assault him. If the rider is hung up as above described, it is very important to be able to very quickly break the bull rope by separating the separable end portions 100 and 102. Then the rider can be freed from the bull and either run away of his own accord or be dragged away from the bull and avoid injury or further injury, and perhaps even to save his life.

Although the latch 42 of the subject invention has been described with regard to a bull rope and bull riding, it will be understood that it could be used in connection with riding any rough animal or even in riding any animal where a rigging is used to assist the rider in maintaining balance on the animal but which could be entangled with a limb of the rider in the event that the rider is thrown from the animal or falls from the animal and cannot easily be extricated from this situation.

Moreover, although a very specific modified construction of a standard bull rope has been described to incorporate the latch 42, it will be understood that many variations of this construction may be employed without departing from the principles of the present invention. In essence, and in its broadest form, all that is required is that the rope or other rigging have separable ends, apart from the ends used to cinch the rigging, that are normally held together by a latch, and that this latch be located for ready access by the rider or an attendant. The rigging need not be a rope, nor a braided rope nor need it involve latch members or plates fastened to the strands of a rope. Simply to incorporate a latch in an animal rigging that holds when the rider is mounted but that can be released when the rider is thrown and hung up is all that is necessary.

It is also to be recognized that automatic and remote means could be used to retract or unlatch the latch 42, such as, a solenoid-operated latch remotely operated by electronic means such as radio control. In this manner, the latch could be retracted even more quickly with the intervention of clowns or the rider.

Although a preferred embodiment of the present invention has been shown and described, and alternate embodiments of various features have been described, various modifications and substitutions may be made thereto without departing from the spirit and scope of the invention. Accordingly, it is to be understood that the present invention has been described by way of illustration and not limitation.

What is claimed is:

1. A latch inserted in an animal rigging having separable parts that allows the rigging to be fastened to the animal when latched but enables the rigging to be divided into the separable parts at the place where the latch is inserted when unlatched, comprising:

first and second coupling members having proximate releasably interfitted end portions and distal rigging-receiving end portions the distal end portions being respectively connected to said separable parts of the rigging; and a pin releasably joining the proximate end portions and being axially slideably movable to allow said proximate end portions to separate.

2. The latch of claim 1, wherein there is an actuating element directly connected to the pin for moving it and causing it to allow said proximate end portions to separate.

3. The latch of claim 2, wherein the actuating element is a flexible pull strap.

4. The latch of claim 3, wherein the strap has indicia thereon.

5. The latch of claim 1, wherein the pin is made of steel.

6. The latch of claim 1, wherein the coupling members are made of steel.

7. The latch of claim 1, wherein the pin is made of steel, and wherein the coupling members are made of steel.

8. A method of using an animal rigging with the latch of claim 1 in the rigging, comprising the step of:

fastening the rigging about the animal with the coupling members joined by the pin, and removing the pin to unfasten the rigging.

9. The method of claim 8 wherein an actuating element is directly connected to the pin, including the further step of:

causing the actuating element to remove the pin from the coupling member.

10. The method of claim 9 wherein the actuating element is a flexible pulling member hanging down from the latch alongside the animal, including the further step of:

pulling on the pulling member and thereby removing the pin from the coupling members.

11. The method of claim 10 wherein there is at least one attendant available near the animal to which the rigging is attached, wherein the attendant pulls on the pulling member to unfasten the rigging.

* * * * *